United States Patent [19]

Nesis

[11] Patent Number: 4,865,324

[45] Date of Patent: Sep. 12, 1989

[54] MAGNETIC WHEEL PUZZLE

[76] Inventor: Dov Nesis, 4 Efter Street, Tel Aviv, Israel

[21] Appl. No.: 152,410

[22] Filed: Feb. 4, 1988

[51] Int. Cl.[4] ..... A63F 9/08

[52] U.S. Cl. ..... 273/155; 434/168; 434/174; 434/190; 434/206

[58] Field of Search ..... 273/155; 40/503; 434/168, 174, 190, 206

[56] References Cited

U.S. PATENT DOCUMENTS 4,295,832 10/1981 Karell ..... 434/168
4,651,992 3/1987 Danino et al. ..... 273/155

FOREIGN PATENT DOCUMENTS 2139861 3/1972 Fed. Rep. of Germany ..... 40/503

*Primary Examiner*—Anton O. Oechsle

[57] ABSTRACT

A puzzle comprises a plurality of puzzle elements held together along a common axis. Each of the puzzle elements includes first and second faces and a peripheral edge. A series of discrete symbols are formed along the peripheral edge of each element. Preferably, the puzzle elements are magnetic wheels held together by magnetic forces. The magnetic wheels have a series of protuberances on one face which are adapted to register with a series of cavities on an opposing face of an adjacent magnetic wheel. The magnetic wheels are rotated relative to each through a series of click-stops which correspond to discrete positions of the magnetic wheels. A solution is achieved when all of the symbols on each of the magnetic wheels are properly aligned.

9 Claims, 2 Drawing Sheets

MAGNETIC WHEEL PUZZLE

BACKGROUND OF THE INVENTION

This invention relates to a puzzle. In its preferred embodiment, this invention relates to a magnetic wheel puzzle wherein a plurality of magnetic wheels are rotated about a common axis relative to each other until the symbols on the peripheral edges of the magnetic wheels align themselves to form a solution to the puzzle.

Puzzles comprising puzzle elements which are rotatable relative to each other are known in the art. The puzzle sold under the trade name RUBIK'S CUBE includes puzzle elements which form planes of a cube. The planes are rotatable relative to each other and a solution is reached when all of the puzzle elements on each of the planes is of the same color.

The present invention represents a departure from Rubik's Cube in that the individual puzzle elements are aligned along a common axis with a peripheral edge exposed outward. Each of the individual puzzle elements has a plurality of symbols on its peripheral edge. The puzzle elements are rotatable relative to each other about their common axis, and a solution is reached when all of the symbols are properly aligned.

SUMMARY OF THE INVENTION

In accordance with its broadest aspect, the present invention is directed to a puzzle comprising a plurality of elements held together along a common axis. The puzzle elements are rotatable relative to each other about the common axis.

Each of the elements includes first and second faces and a peripheral edge. A series of discrete symbols are formed along the peripheral edge of each puzzle element. The symbols are aligned to form a correct solution to the puzzle when the puzzle elements assume a selected position.

In a preferred embodiment, the puzzle elements comprise magnetic rings which are stacked next to each other and held together by magnetic forces. Each of the puzzle elements has protuberances which are adapted to be received within cavities on the face of an adjacent puzzle element. Thus, the puzzle elements can assume discrete positions when the protuberances register with the cavities. When the protuberances are received within their corresponding cavities, the symbols on the peripheral edge of the puzzle elements are aligned. A solution is achieved when all of the symbols are aligned in a logical fashion, e.g., to form a complete picture, a series of words, etc.

In one especially preferred embodiment of the invention, the symbols on the peripheral edges of the magnetic wheel elements are a series of numbers and algebraic operators. A correct solution is arrived at if all of the symbols of the magnetic wheels are aligned to form correct mathematic formulas (e.g., $1\times3=3$; $3-1=2$; etc.)

DETAILED DESCRIPTION OF THE INVENTION

Figure 1:
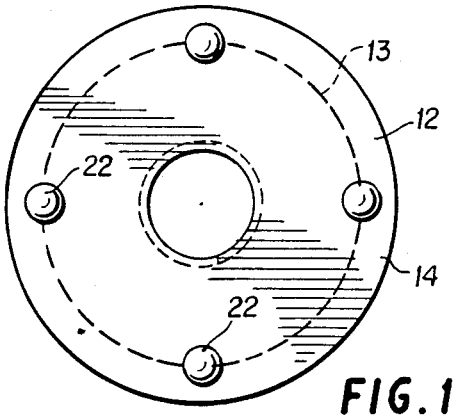
FIG. 1 is a plan view of a puzzle element in accordance with the present invention.
Figure 3:
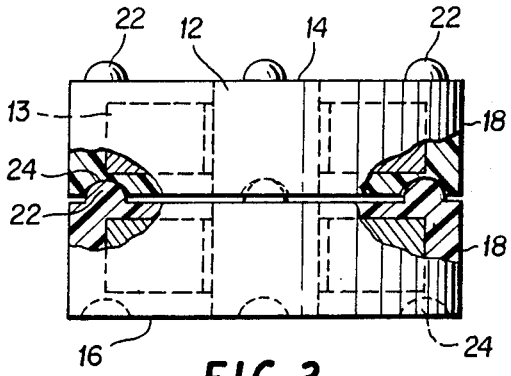
FIG. 3 is a side view of two puzzle elements stacked on top of each other.
Figure 2:
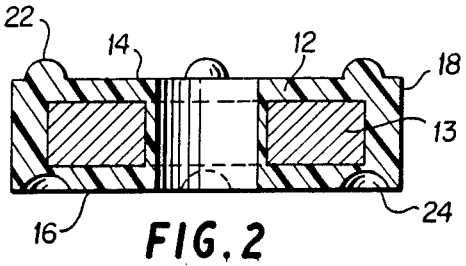
FIG. 2 is a cross-sectional view of a puzzle element.
Figure 4:
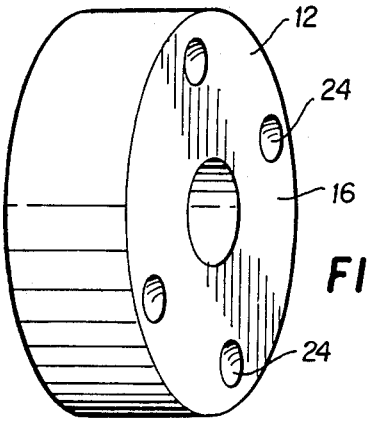
FIG. 4 is a perspective view showing the inside of the puzzle element.
Figure 6:
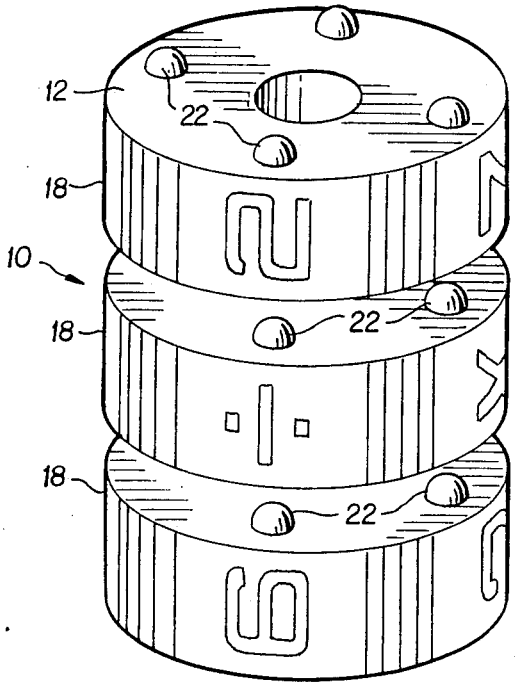
FIG. 6 is a perspective view showing a series of puzzle elements stacked on top of each other with the symbols on the peripheral edges of the puzzle elements.
Figure 5:
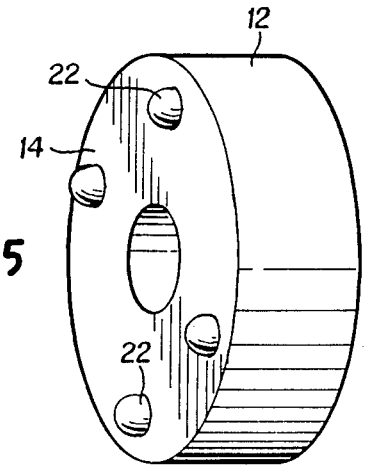
FIG. 5 is a perspective view of a puzzle element.

FIGS. 1–6 illustrate a puzzle 10 in accordance with the present invention, which comprises a series of puzzle elements 12. Puzzle elements 12 in this embodiment are made from a hard plastic shell encasing a magnetic ring 13. Puzzle elements 12 may be described as magnetic wheels. The plastic shells of each magnetic wheel may be of a different color.

Magnetic wheels 12 are disk-like in shape, and include front and rear flat faces 14 and 16 and a peripheral edge 18. Along one face 14 of each wheel 12 is a plurality of protuberances 22. In the illustrated embodiment, there are four such protuberances. Protuberances 22 are made from plastic and are symmetrically spaced about the center of the wheel 12. On the other face 16 of each wheel, is an equal number of cavities 24 which are spaced symmetrically about the wheel 12 and are sized to receive protuberances 22 of an adjacent wheel 12.

Because the wheels 12 are held together by magnetic forces, they may be rotated relative to each other about a common axis from one position, wherein protuberances 22 are received within cavities 24, to another alignment wherein the protuberances are received within the cavities. These discrete positions are referred to herein as "click-stops" because of the sound that is made when the wheels 12 assume the discrete positions.

Desirably, an annular groove (shown in the embodiment of FIGS. 7–8) connects the cavities 24 on the face 16 of the wheel. These grooves serve as guiding surfaces to facilitate the rotation of the wheels 12 relative to each other and to guide protuberances 22 from one "click stop" to another "click stop". Thus, the wheels are rotatable relative to each other and are engagable only at a selected number of positions which correspond to click-stops.

On the peripheral edge 18 of each wheel 12 is a series of symbols. These symbols may comprise numbers and algebraic operators. Alternatively, the symbols on the peripheral edge 18 of the wheels may comprise letters of the alphabet, a portion of a picture, a color, etc.

When the puzzle elements 12 are rotated relative to each other, the symbols are aligned for each click-stop. However, only a select number of click-stops, preferably only a single click-stop, provide a solution to the puzzle. Thus, for example, in the case where the symbols comprise numbers and algebraic operators, the solution to the puzzle will be achieved only when all of the mathematical formulas displayed are correct.

It will be recognized that the puzzle element need not necessarily be circular but may also be square or triangular shaped. It is only necessary that the puzzle elements be rotatable relative to each other and have a peripheral edge with symbols thereon displayed outwardly.

It will further be recognized that the magnetic wheels may each be detached from the stack and placed in a different relative position. This increases the possibilities for different combinations of the elements.

Figure 7:
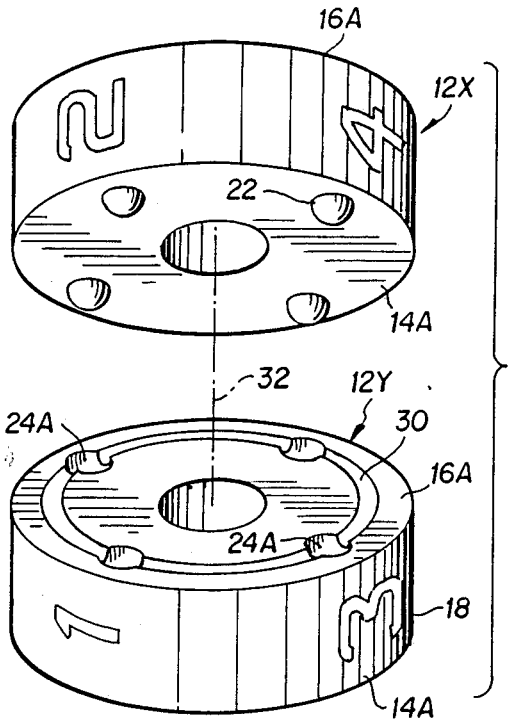
FIG. 7 is an exploded perspective view of two puzzle elements constructed in accordance with another embodiment of the invention.
Figure 8:
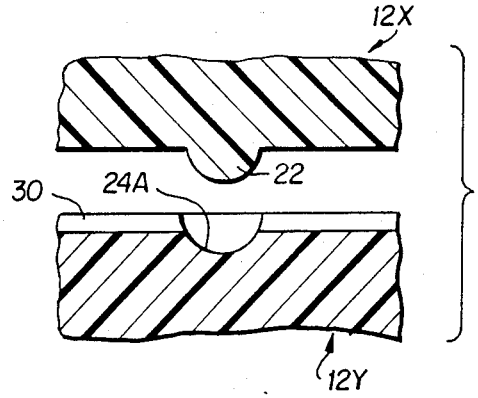
FIG. 8 is a partial sectional view of the elements of FIG. 7.

FIGS. 7–8 illustrate magnetic wheel elements 12X, 12Y, constructed in accordance with another embodiment of the invention, wherein a first face 16A of each element such as 12Y has a circular groove 30 concentric with an axis 32 of the element. Cavities 24A are spaced along the groove. The second face 14A of each element such as 12X has a plurality of protuberances 22 formed to lie in and move along the groove 30 of another adjacent element 12Y as the elements rotate relative to each other about their coincident axes 32. The protuberances 22 all enter the cavities 24A of the adjacent element at certain relative rotational positions of the elements 12X, 12Y, to resist further element rotation and therefore to tend to retain the elements at the selected relative positions.

The wheel elements such as 12X, 12Y are usually arranged in a stack. As can be seen by inspection of the various figures of the drawing, each element can be removed from an adjacent element in the stack by slightly separating it from the adjacent element and moving it perpendicular to its axis. Each projection is tapered to enable sliding of one element off another. The elements are free of attachment to one another except through magnetic attraction and the reception of protuberances of one elements in the groove and cavities of another, to enable rigid disassembly of a stack and its reassembly in another arrangement.

While the invention has been described by reference to specific embodiments, this was for purposes of illustration only, and should not be construed to limit the spirit or the scope of the invention.

I claim:

1. A puzzle comprising:

a plurality of wheel elements each having an axis and each having first and second opposite faces and a symbol-forming peripheral edge, said wheel elements being magnetic with the first face of each elements being magnetically attracted to the second face of another element;

the first face of each element having a circular groove concentric with the axis of the element, and the second face of each element having a plurality of protuberances formed to be received in the groove of another element, the elements being held in a stack with their axes coincident substantially only by magnetic force, and each element being removable from an adjacent element in the stack by moving it substantially perpendicular to its axis.

2. The puzzle described in claim 1 wherein:

the first face of each element has a plurality of cavities located in the bottom of the groove therein, each protuberance being receivable in said cavities to provide a click stop as one wheel element rotates on another, to resist further element rotation.

3. A puzzle comprising:

a plurality of wheel elements, each having an axis and each having first and second opposite faces and a symbol-forming peripheral edge forming a plurality of symbols spaced about the peripheral edge, said wheel elements being magnetic with the first face of each element being magnetically attracted to the second face of another element;

the first face of each element having a circular groove concentric with the axis of the element and a plurality of cavities spaced along each groove, and the second face of each element having a plurality of protuberances formed to lie in and move along the groove of another element as the elements rotate relative to each other and to all enter the cavities of said another element at predetermined relative rotational positions of the elements;

said elements being free of attachment to one another except through said magnetic attraction and the entrance of the protuberances of one element, whereby to enable rapid disassembly of a stack of said elements and reassembly in another stack arrangement.

4. The puzzle described in claim 3 wherein:

said protuberances have tapered sides, whereby to facilitate sliding one element off another element.

5. A puzzle comprising:

a plurality of puzzle elements each having an axis and each having first and second opposite faces and a symbolforming peripheral edge forming a plurality of symbols about said peripheral edge, said puzzle elements being magnetic with said first face of each of said elements being magnetically attracted to said second face of each other of said elements, said elements being held in a stack with their axes coincident substantially only by magnetic force, and each of said elements being removable from an adjacent one of said elements in said stack by moving it substantially perpendicular to its axis and returnable to said stack by moving it to a position with its axis aligned with the axes of said elements of said stack and its first or second face abutting an exposed second or first face at an end of said stack;

said symbols on peripheral edges of said elements being intended for proper viewing only when all of said elements in said stack are in a given orientation relative to one another, and the magnetic interaction of said first and second faces being such that no element can be magnetically held in a stack in the wrong orientation for proper viewing of its symbols.

6. A puzzle comprising:

a plurality of puzzle elements, each having an axis and each having first and second opposite faces and a symbol-forming peripheral edge forming a plurality of symbols spaces about said peripheral edge, said elements being magnetic with said first face of each element being magnetically attracted to said second face of another element;

said first face of each element having a major substantially planar portion, a circular groove concentric with the axis of the element and a plurality of cavities spaced along said groove, and the second face of each element having a major substantially planar portion and a plurality of protuberances formed to lie in and move along said groove of another element as said elements rotate relative to each other and to all enter said cavities of said another element at predetermined relative rotational positions of said elements, said elements being held in a stack with their axes coincident and said substantially planar portions of adjacent faces substantially abutting, said elements being free of attachment to one another except through said magnetic attraction and the disposition of said protuberances of one element into said groove and cavities of said another element, thereby to enable rapid disassembly of a stack of said elements and reassembly in another stack arrangement;

said protuberances, said grooves and said cavities being configured and dimensioned such that in cooperation with said magnetic attraction relative rotation of an adjacent pair of elements in said stack automatically causes said substantially abutting substantially planar portions of said adjacent element pair initially to separate slightly along their coincident axes as they leave one of said predetermined relative rotational positions and finally to approach slightly and resume being substantially abutting as they assume another one of said predetermined relative rotational positions.

7. The puzzle of claim 6 wherein said first and second faces are formed so that when said substantially planar portions of said adjacent element pair resume being substantially abutting, they provide an audible signal that said another predetermined relative rotational position has been assumed by said adjacent element pair.

8. The puzzle of claim 6 wherein said protuberances, said grooves and said cavities are configured and dimensioned such that said slight separation of said faces of said adjacent element pair upon initial relative rotation facilitates further relative rotation of said slightly separated faces by reducing said magnetic attraction therebetween while still permitting said magnetic attraction to maintain said protuberances within said groove.

9. The puzzle of claim 6 wherein said protuberances are of fixed configuration and disposition relative to said second face, whereby axial movement of a protuberance relative to said first face of said another element causes movement of said second face and hence the entirety of said element relative to said another element.

* * * * *